US006929734B2

(12) United States Patent
Goto

(10) Patent No.: US 6,929,734 B2
(45) Date of Patent: Aug. 16, 2005

(54) APPARATUS AND METHOD FOR FEEDING WIRE IN TREATMENT LIQUID

(75) Inventor: Yoshihide Goto, Yamagata (JP)

(73) Assignee: Goto Electronic, Co., Ltd., Yamagata (JP)

( * ) Notice: Subject to any disclaimer, the term of this patent is extended or adjusted under 35 U.S.C. 154(b) by 441 days.

(21) Appl. No.: 10/212,528

(22) Filed: Aug. 5, 2002

(65) Prior Publication Data

US 2003/0136678 A1 Jul. 24, 2003

(30) Foreign Application Priority Data

Jan. 23, 2002 (JP) ..... 2002-013916

(51) Int. Cl.[7] ..... C25D 17/00

(52) U.S. Cl. ..... 205/138; 204/206; 204/207; 204/248

(58) Field of Search ..... 204/206, 207, 204/248; 205/138

(56) References Cited

U.S. PATENT DOCUMENTS 4,751,362 A * 6/1988 Girardin ..... 219/69.12
5,242,571 A * 9/1993 Sein et al. ..... 205/138

* cited by examiner

*Primary Examiner*—Arun S. Phasge
(74) *Attorney, Agent, or Firm*—Reising, Ethington, Barnes, Kisselle, P.C.

(57) ABSTRACT

The apparatus is provided with a wire guiding means disposed in a liquid bath for turning the direction of a wire to feed the wire into and out of the bath contained by the liquid. The wire guiding means includes a tubular conduit having a first open end disposed in the liquid, a second open end disposed above the liquid, and a middle curved portion for guiding the wire through the tubular conduit. The tubular conduit can be at least partially filled with the liquid. Preferably, the treatment liquid is an electrodeposition liquid. A plurality of the tubular conduits may be disposed in the bath substantially parallel with each other. Preferably the first open end is connected to a bottom portion of the bath through a coupling such that the treatment liquid in the bath can flows into the tubular conduit. The second open end is positioned higher than the first open end. Preferably, the apparatus further includes a main supporting shaft and a secondary supporting shaft positioned opposed to the main supporting shaft. The main supporting shaft has a channel defined on an outer peripheral surface thereof for receiving and contacting an inner curvature surface of the curved portion of the tubular conduit, while the secondary supporting shaft contacts an outer curvature surface of the curved portion to support the curbed portion of the tubular conduit therebetween.

20 Claims, 8 Drawing Sheets

APPARATUS AND METHOD FOR FEEDING WIRE IN TREATMENT LIQUID

BACKGROUND OF THE INVENTION

1. Field of the Invention

The present invention relates to an apparatus and a method for feeding a wire in a treatment liquid contained in a liquid bath, particularly in an electrodeposition liquid bath for providing an insulating film on an outer peripheral surface of a wire like an electrical conductor. The apparatus can provide a constant appropriate tensile force to the wire without looseness so that the wire receives no excessive force to be reliably fed in the liquid with no damage of the wire.

2. Related Art

A known conventional method passes a wire like an electrical conductor in an electrodeposition liquid bath filled with an electrodeposition liquid for providing an insulating film on an outer peripheral surface of the conductor.

In the method, the wire is supplied from a supply unit having a wire winding bobbin and is cleaned to eliminate dust and contaminants therefrom. Then, the wire passes through a direction changing means to orient the wire toward the electrodeposition liquid bath filled with the electrodeposition liquid bath before the wire passes in the electrodeposition liquid bath for providing an insulating film on an outer peripheral surface of the wire.

Generally, a rolling support such as a roller or a pulley is used for continuously feeding a wire, for making some treatment on the wire, for moving the wire, and for changing the orientation of the wire.

FIGS. 3 to 5 show a conventional wire feeding method employing rolling supports to function as a wire guiding means.

The method uses an upper roller a rotated by a driving motor and a lower roller c disposed to be opposed to the upper roller a. The lower roller c contacts the roller a so as to be rotated with the rotation of the upper roller a. The roller a has a channel b formed in an outer circumferential surface thereof to receive a wire w such as an electrical conductor.

The motor rotates the upper roller a, which in turn rotates the lower roller c contacting the upper roller c, so that the wire w received in the channel b of the upper roller a is moved forward.

FIGS. 6 to 8 show another conventional wire feeding method employing rollers as rolling supports. The method uses an upper roller a' rotated by a driving motor and a lower roller c' disposed to be opposed to the upper roller a'. The lower roller c' contacts the upper roller a' so as to be rotated with the rotation of the upper roller a. The roller a' has a channel b' formed in an outer circumferential surface thereof to receive a wire w such as an electrical conductor. The lower roller c' has a circumferential projection d' formed on an outer surface thereof so as to be partially received in the channel b'.

The motor rotates the upper roller a', which in turn rotates the lower roller c' contacting the upper roller a', so that the wire w is received between the channel b' of the upper roller a' and the circumferential projection d' of the lower roller c'.

FIGS. 9 to 11 show further another conventional wire feeding method employing rollers as rolling supports. The method uses an upper gear a" rotated by a driving motor and a lower gear c" disposed to be opposed to the upper gear a".

The lower gear c" engages with the upper gear a" so as to be rotated with the rotation of the upper gear a". The upper gear a" has a channel b" formed in an outer circumferential surface thereof to receive a wire w such as an electrical conductor. The motor rotates the upper gear a", which in turn rotates the lower gear c" engaged with the upper gear a", so that the wire w is received in the channel b" of the upper gear a" so as to be moved forward.

In the conventional wire feeding methods employing the rolling supports of FIGS. 3 to 11, driving forces of the motors forcedly rotate the upper rollers a, a' and the lower rollers c, c' or the gear a" and the gear c" to reduce a larger tensile force which would be otherwise exerted on the wire w due to a long feeding distance or due to the orientation change of the wire w.

Furthermore, when the wire w is moved forward in a liquid such as an electrodeposition liquid, the wire feeding force needs to be intentionally adjusted according to the viscosity of the liquid, the feed speed of the wire, and the orientation change of the wire.

However, in the conventional wire feeding method employing the rolling supports of FIGS. 3 to 5, the tensile force of the wire is released to have a looseness when the motor stops its rotation. Thereby, the wire w may not be automatically set at a correct position relative to the rollers a and c when the motor restarts the operation, resulted in an disadvantage that the wire can not be moved forward immediately due to the disengagement of the wire w from the channel b of the roller a.

In the conventional wire feeding method employing the rolling supports of FIGS. 6 to 8, when the wire has a larger diameter, the wire may possibly disengage from the channel b' so that the wire w is disadvantageously jammed between the upper roller a' and the lower roller c'. This causes damage or breaking of the wire.

In the conventional wire feeding method employing the rolling supports of FIGS. 9 to 11, the upper gear a" engages with the lower gear c". Thus, when the wire w is disengaged from the channel b", the wire is jammed between the teeth of the gears, disadvantageously causing damage or breaking of the wire.

In view of the disadvantages of the aforementioned conventional wire feeding methods, an object of the invention is to provide an apparatus and a method for feeding a wire in a treatment liquid, which provides a constant appropriate tensile force to the wire without looseness of the wire during a pause of the apparatus. The apparatus can correctly feed the wire without disengagement of the wire from a predetermined feeding path not to exert an excessive force on the wire to cause no damage of the wire. The apparatus also enables a continuos feeding of the wire with no damage thereof, enabling an improved workability, an easy replacement of parts, an easy maintenance, a simple construction, and an easy manufacturing and assembling thereof with a reduced cost.

SUMMARY OF THE INVENTION

For achieving the object, a first aspect of the invention is an apparatus for feeding a wire such as an electrical conductor in a treatment liquid. The apparatus includes:

a liquid bath containing the treatment liquid and a wire guiding means disposed in the bath for turning the direction of the wire to feed the wire into and out of the bath. The wire guiding means has a tubular conduit having a first open end disposed in the liquid, a second open end disposed above the liquid, and a middle curved portion for guiding the wire through the tubular conduit that is at least partially filled with the liquid.

Preferably, the treatment liquid is an electrodeposition liquid and the treatment liquid bath contains the electrodeposition liquid. The treatment liquid may be a cleaning water or a galvanizing liquid.

A plurality of the tubular conduits may be disposed in the treatment liquid bath substantially parallel with each other.

Preferably the tubular conduit is made from a prefabricated tube and the first open end is connected to a bottom portion of the treatment liquid bath through a coupling such that the treatment liquid in the treatment liquid bath can flow into the tubular conduit, while the second open end is fitted on a support member. The second open end is positioned higher than the first open end.

Preferably, the apparatus further includes a main supporting shaft and a secondary supporting shaft positioned opposed to the main supporting shaft, the main supporting shaft having a channel defined on an outer peripheral surface of the main supporting shaft for receiving and contacting an inner curvature surface of the curved portion of the tubular conduit, the secondary supporting shaft having an outer peripheral surface for contacting an outer curvature surface of the curved portion, whereby the curbed portion of the tubular conduit is supported by the main supporting shaft and the secondary supporting shaft therebetween.

Preferably, the apparatus further has a motor-driven winding unit for winding up the wire after the wire has passed the treatment liquid bath and has a wire feeding unit with an automatic tension device for feeding the wire with a tension force exerted on the wire.

The tubular conduit may be made of a synthetic resin material like a polyurethane resin material or may be made of a metal like a stainless steel and a copper alloy.

A second aspect of the invention is a method for feeding a wire such an electrical conductor in a treatment liquid contained in a liquid bath comprising that the wire is moved through a tubular conduit having a first open end disposed in the liquid, a second open end disposed above the treatment liquid, and a middle curved portion for guiding the wire through the tubular conduit. The treatment liquid may be an electrodeposition liquid and the treatment liquid bath contains the electrodeposition liquid.

A third aspect of the invention is an apparatus for feeding a wire such as an electrical conductor in treatment liquid, which include:

a first liquid bath containing a first treatment liquid, a second liquid bath containing a second treatment liquid, and a wire guiding means disposed in the first liquid bath for turning the direction of the wire in the first liquid bath to feed the wire into and out of the first liquid bath. The wire guiding means includes a tubular conduit having a first open end disposed in the first liquid, a second open end connected to the second treatment liquid bath, and a middle curved portion for guiding the wire through the tubular conduit that is filled with the first liquid. The first treatment liquid is the same as the second treatment liquid or may be different from the second treatment liquid in treatment properties.

Now, operational effects of the present invention will be discussed. Since the invention enable a constant appropriate tensile force to the wire without looseness of the wire at a pause of the apparatus, the apparatus can correctly feed the wire without disengagement of the wire from a predetermined feeding path not to exert an excessive force on the wire to cause no damage of the wire. The apparatus also enables a continues feeding of the wire with no damage thereof, enabling an improved workability, an easy replacement of parts, an easy maintenance, a simple construction, and an easy manufacturing and assembling with a reduced cost. The lubricity of the electrodeposition liquid contained in the electrodeposition liquid bath serves to smoothly feed the wire through the guiding conduit. The plurality of wires are moved through the plurality of tubular conduits in the treatment liquid bath. This improves the workability of the apparatus, since each wire can be independently controlled in transfer speeds and times, pauses, and restart timings according to the size of the wire. Furthermore, the tubular conduit can be easily formed to have a smooth curvature and can simplify the fitting and replacement of parts with an easy maintenance thereof.

In addition, the electrodeposition liquid is quickly introduced into the tubular conduit by a siphon effect so that the lubricity of the electrodeposition liquid enables a less friction force exerted on the wire, achieving a smooth transfer of the wire.

Moreover, the wire, which is supplied from the top of the first treatment liquid bath, is downwardly received in the tubular conduit 4 and turns upward to be smoothly moved in the second treatment liquid bath without an excessive tensile force exerted on the wire. The wire suffers neither damage nor breaking, allowing a constant continues transfer thereof.

DETAILED DESCRIPTION OF PREFERRED EMBODIMENT

Figure 1:
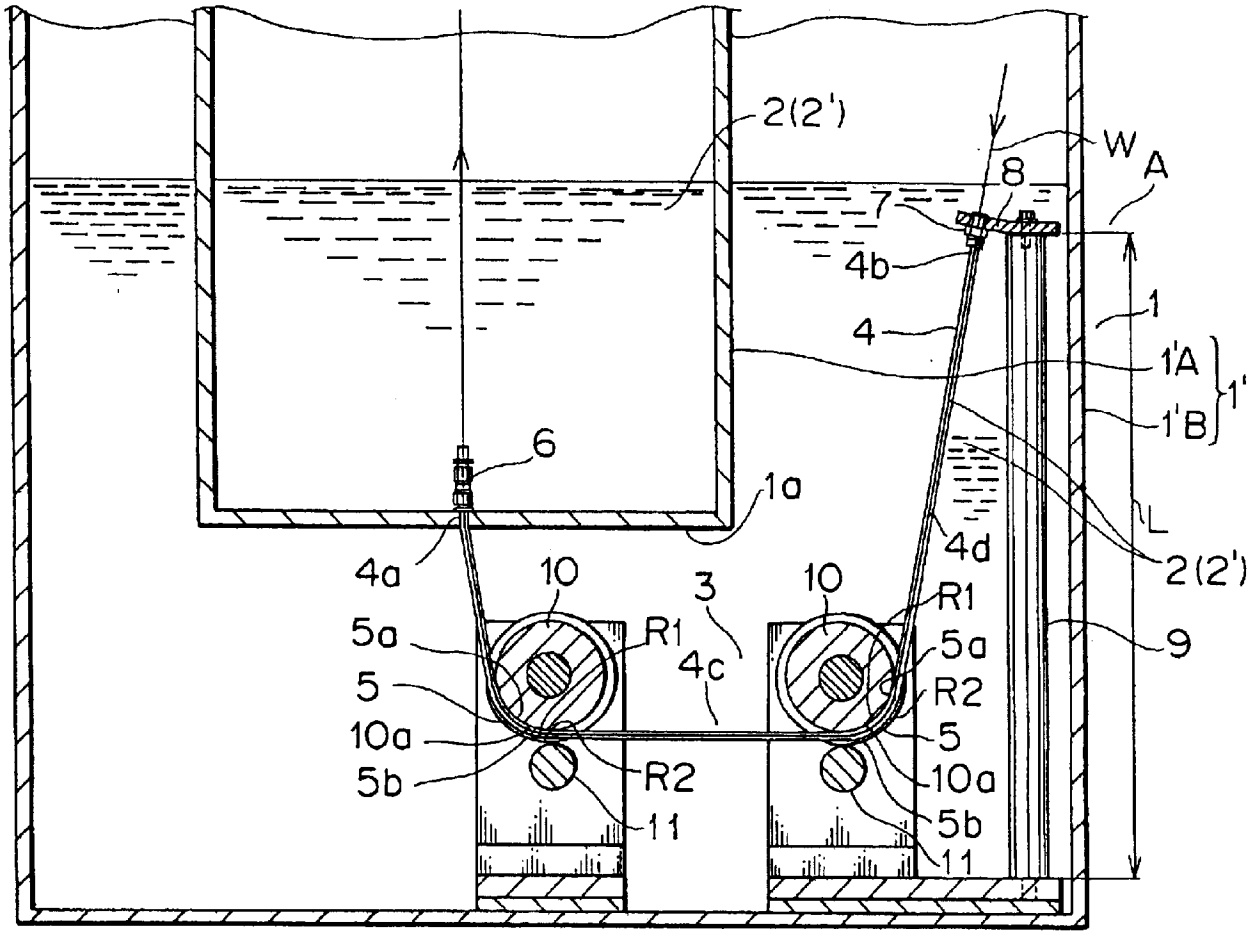
FIG. 1 is a sectional view showing an embodiment of an apparatus according to the present invention for feeding a wire in a treatment liquid.
Figure 2:
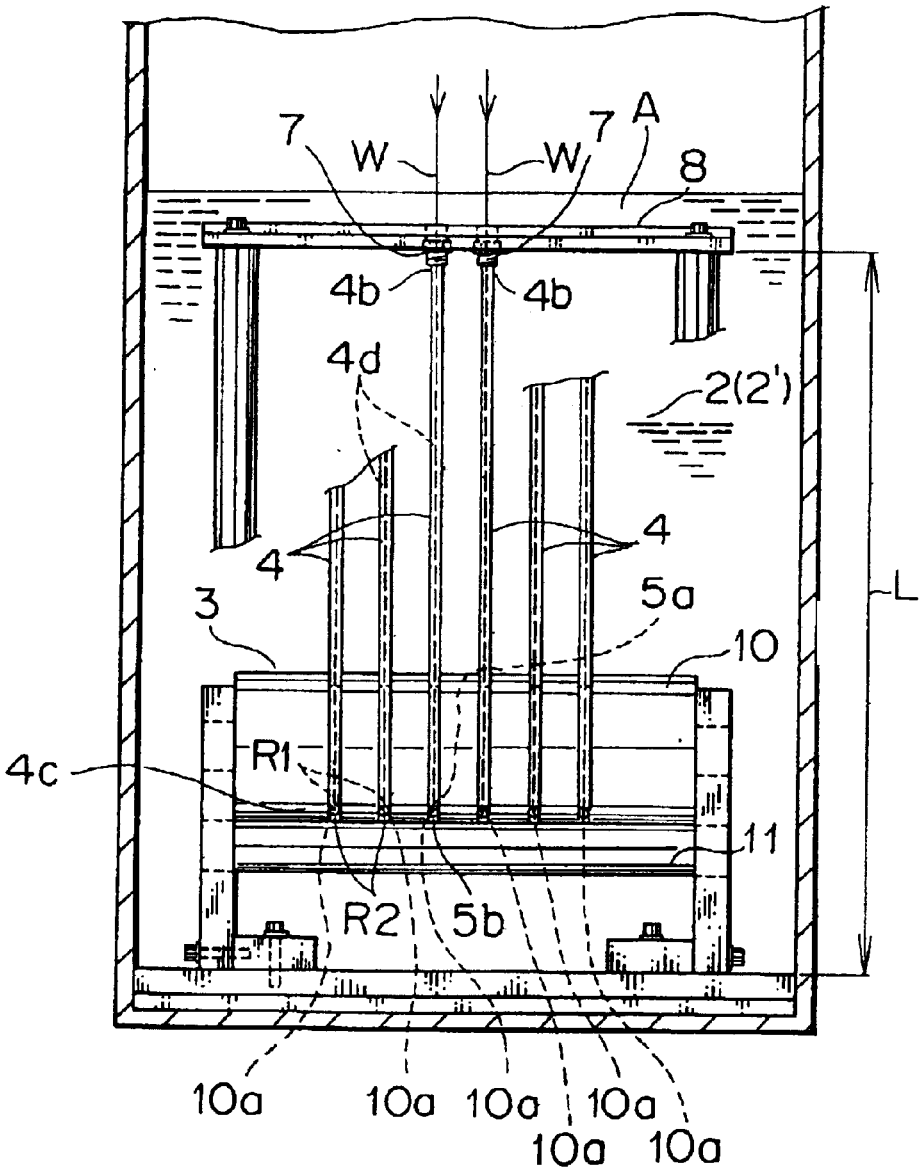
FIG. 2 is a front view showing the apparatus of FIG. 1.
Figure 3:
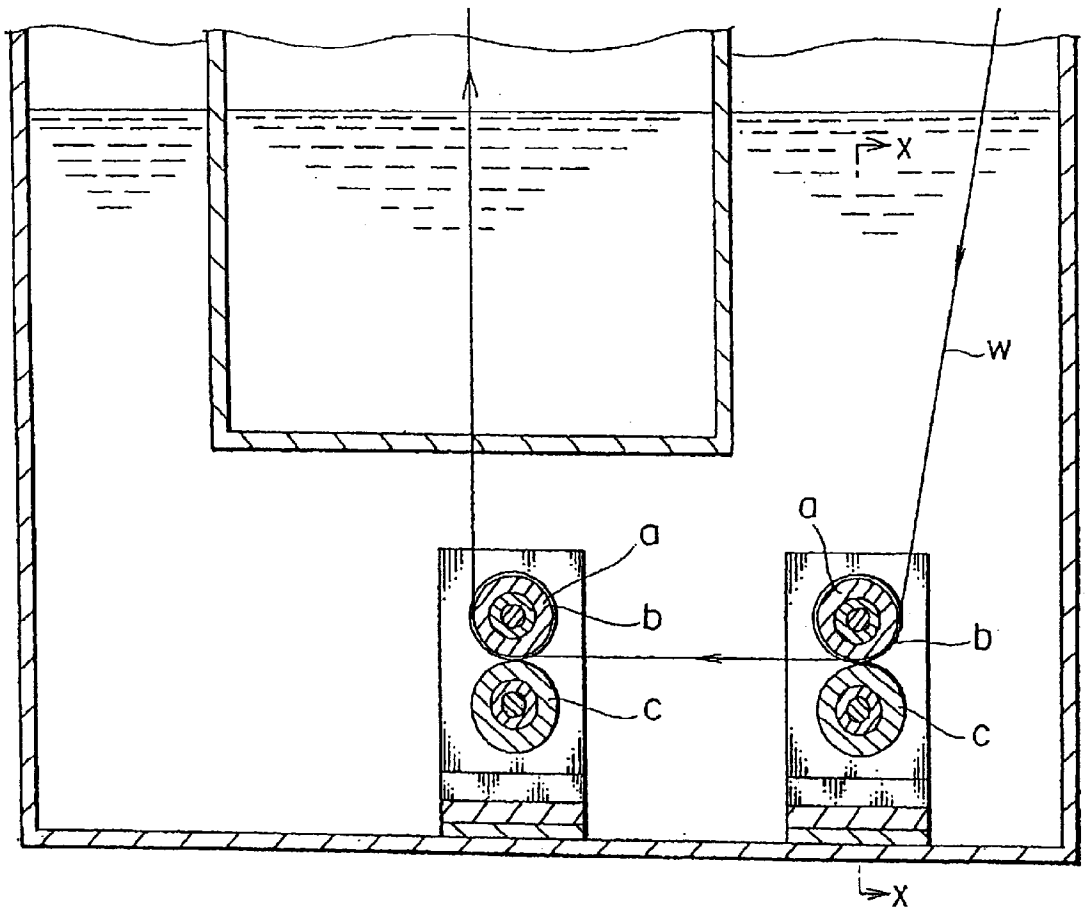
(Prior Art) FIG. 3
FIG. 3 is a sectional view showing a conventional apparatus employing rolling members for feeding a wire in a treatment liquid.
Figure 4:
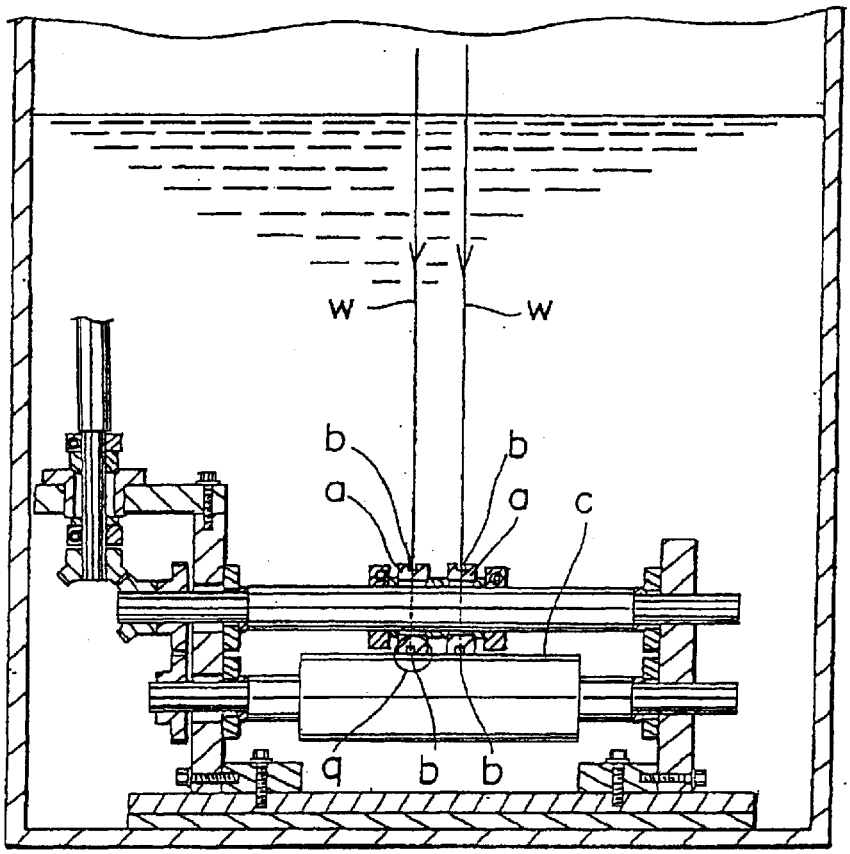
(Prior Art) FIG. 4
FIG. 4 is a sectional view taken on line X—X of FIG. 3.
Figure 5:
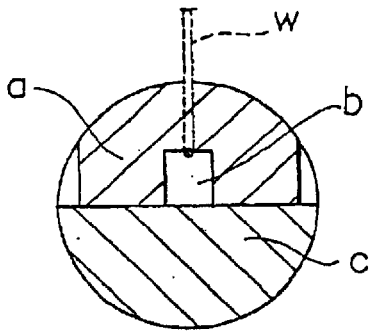
(Prior Art) FIG. 5
FIG. 5 is an enlarged sectional view showing a part surrounded by a circle q of FIG. 4.
Figure 6:
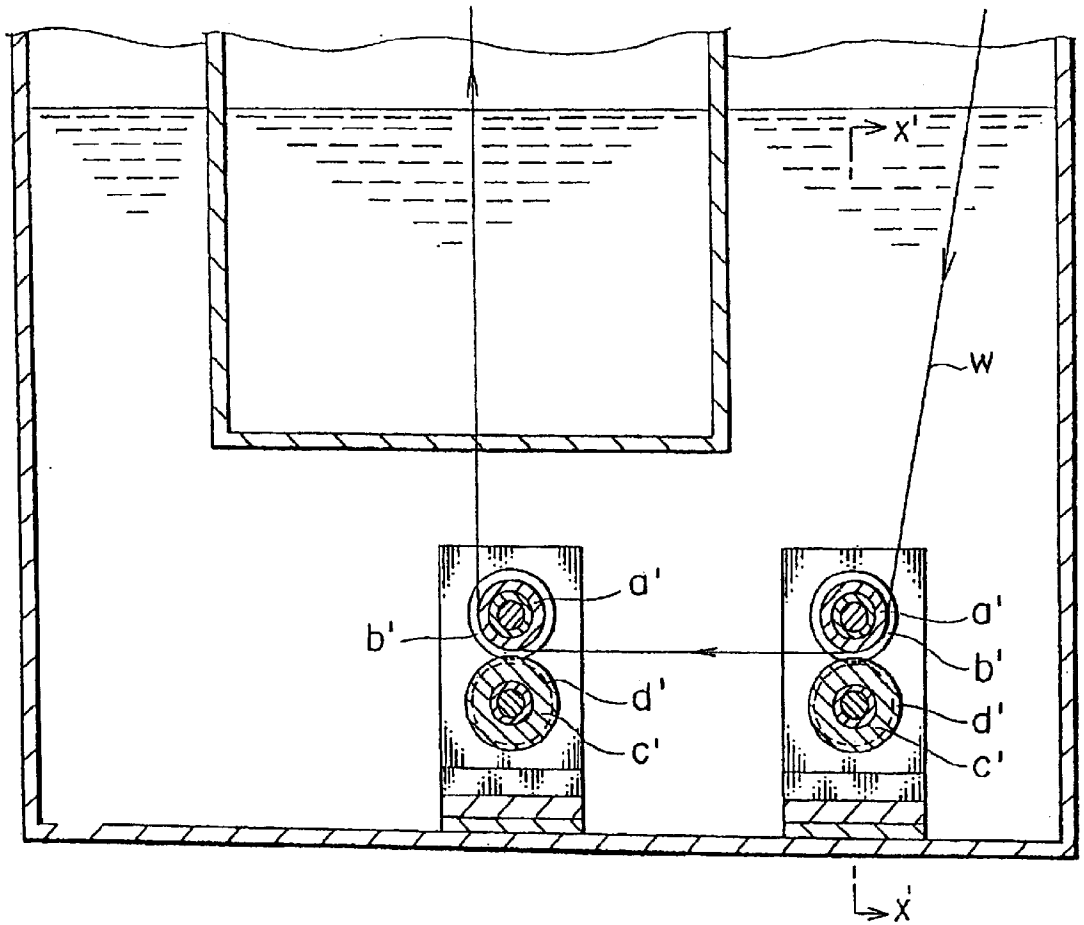
(Prior Art) FIG. 6
FIG. 6 is a sectional view showing another conventional apparatus employing rolling members for feeding a wire in a treatment liquid.
Figure 7:
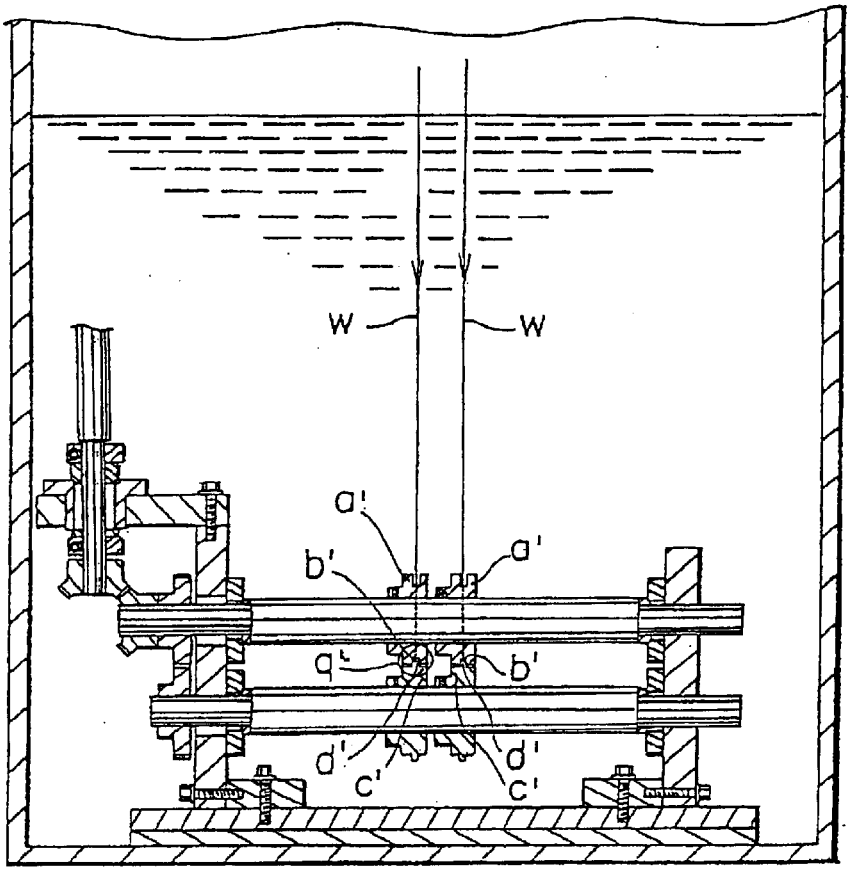
(Prior Art) FIG. 7
FIG. 7 is a sectional view taken on line X'—X' of FIG. 6.
Figure 8:
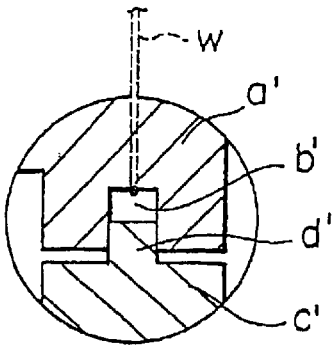
(Prior Art) FIG. 8
FIG. 8 is an enlarged sectional view showing a part surrounded by a circle q' of FIG. 7.
Figure 9:
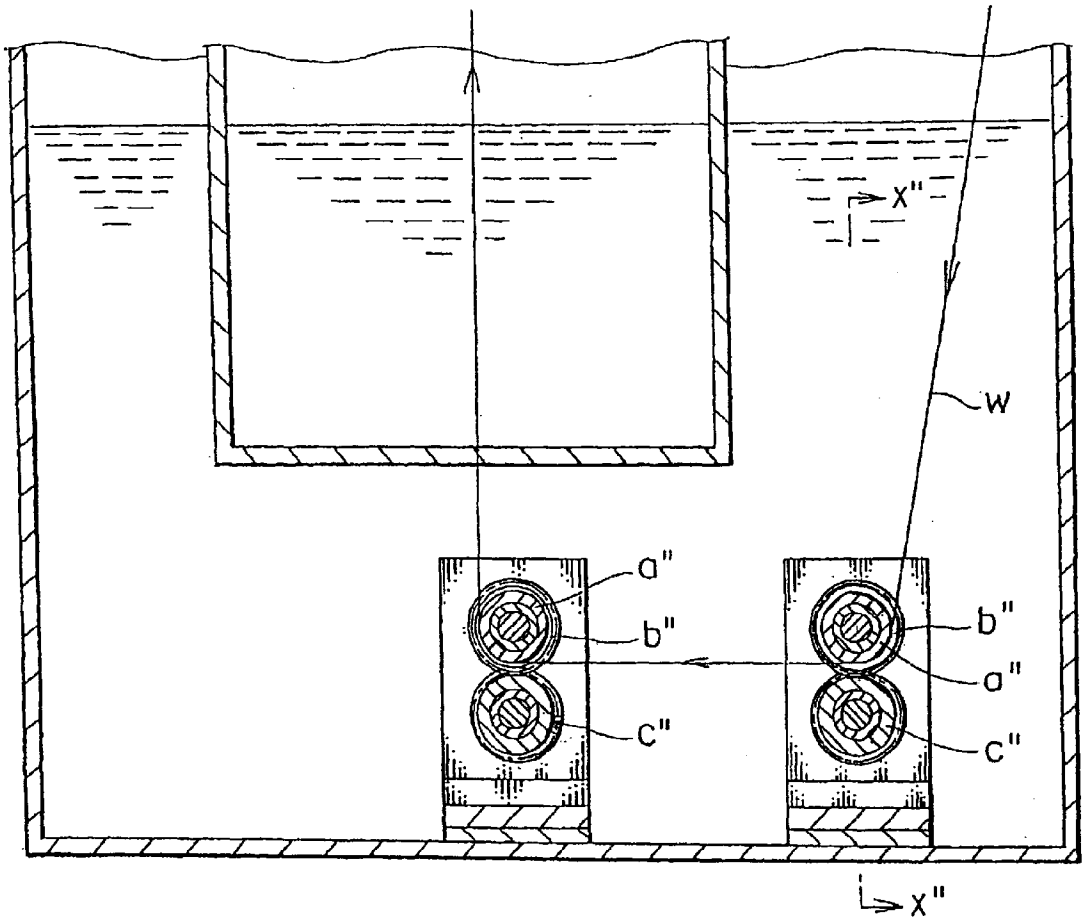
(Prior Art) FIG. 9
FIG. 9 is a sectional view showing further another conventional apparatus employing rolling members for feeding a wire in a treatment liquid.
Figure 10:
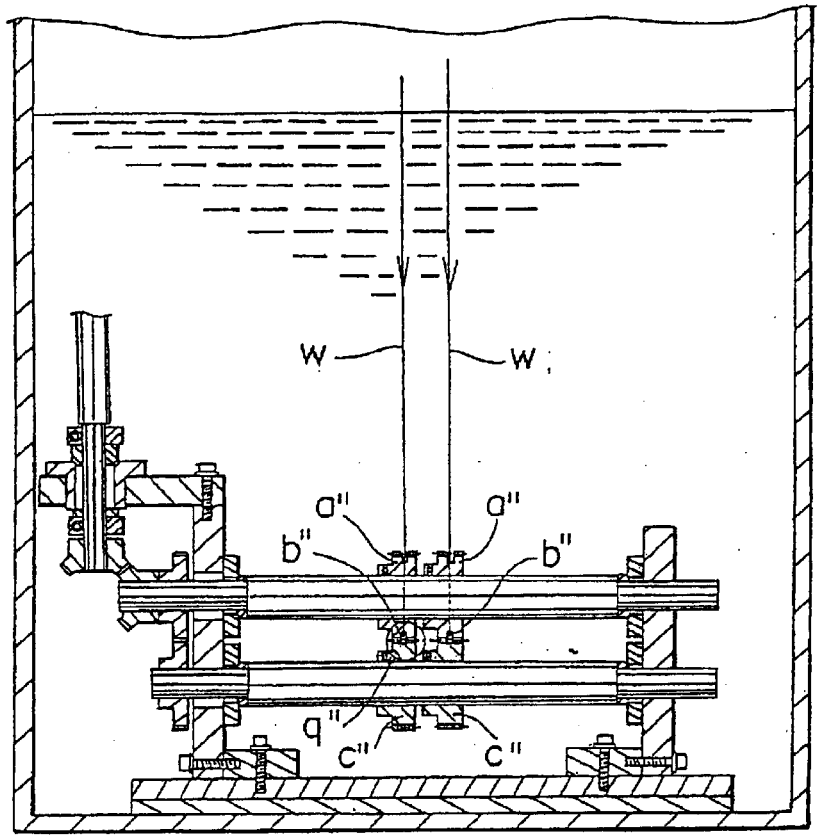
(Prior Art) FIG. 10
FIG. 10 is a sectional view taken on line X"—X" of FIG. 9.
Figure 11:
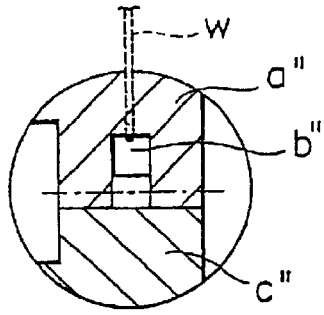
(Prior Art) FIG. 11
FIG. 11 is an enlarged sectional view showing a part surrounded by a circle q" of FIG. 10.

Referring to the accompanied drawings, an embodiment of the present invention will be discussed. FIGS. 1 and 2 show an embodiment of the present invention, which is adapted for providing an insulating film on an outer peripheral surface of an electrical conductor. In the embodiment, a liquid bath 1 contains a treatment liquid 2 and a wire guiding means 3 is disposed in the liquid bath 1. Through the wire guiding means 3, a wire is moved upward from a lower part 1*a* so that a desired treatment of the wire is provided like the conventional wire feeding methods shown in FIGS. 3 to 11.

In the embodiment, the treatment liquid 2 is an electrodeposition liquid 2' and the liquid bath 1 is an electrodeposition liquid bath 1' containing the electrodeposition liquid 2'. The liquid bath 1 filled with the electrodeposition liquid 2' is appropriately used for providing an insulating film on an outer peripheral surface of the wire W. The electrodeposition liquid bath 1' has an inner bath 1'A and outer bath 1'B in the embodiment. However, the electrodeposition liquid bath 1' may have a single bath to embody the present invention.

The wire guiding means 3 of the embodiment is arranged from the side of the inner bath 1'A to the outer bath 1'B. The wire guiding means 3 has a tubular conduit 4. The tubular conduit 4 has one end 4*a* connected to the inner bath 1'A, the other end 4*b* opened at an upper position of the electrodeposition liquid bath 1', and a middle portion 4*c* provided with a curbed portion 5. The tubular conduit 4 can be filled with the treatment liquid 2, e.g., the tubular conduit 4 receives the electrodeposition liquid 2' from the electrodeposition liquid bath 1'. The wire is guided by the tubular conduit 4 so that the wire has no looseness even when the feeding of the wire is stopped. The wire W is not disengaged from a predetermined feeding path so that an excessive force will not be exerted on the wire to cause neither damage nor breaking of the wire when the wire feeding is restarted. Thus, the wire W can be efficiently moved with an appropriate constant tension force exerted thereon.

The tubular conduit 4 is defined by a flexible tube. The one end 4*a* of the tubular conduit 4 is secured to the inner bath 1'A of the electrodeposition liquid bath 1' of the treatment liquid bath by a coupling 6 such that the inside hollow 4*d* of the tubular conduit 4 communicates with the inside of the electrodeposition liquid bath 1', while the other end 4*b* of the tubular conduit 4 is secured by another coupling 7 to a fitting plate 8 fitted on an upper end of a support pillar 9. In the embodiment, the tubular conduit 4 is defined in a U-shape in a side view thereof (FIG. 1).

The support pillar 9 has a length L which may be desirably modified in consideration of the size of the electrodeposition liquid bath 1', a room space for arrangement thereof, a desirable treatment distance of the wire, etc.

The couplings 6 and 7 of the embodiment are applied for an easy and reliable connection to the electrodeposition liquid bath 1' or the fitting plate 8, but the illustrated ones of the couplings, the one end 4*a*, and the other end 4*b* of the tubular conduit 4 are not limited in the present invention but a modified design of them may be possible.

In the embodiment, the tubular conduit 4 is made of, e.g. a polyurethane resin, which is obtained with a low cost, to insure a resistance property against chemicals, impact pressure, wear, and heat. However, the material is not limited in the polyurethane resin but may be a metal such as a stainless steel and a copper alloy to define the tubular member.

The one end 4*a* of the tubular conduit 4, which is fitted on the lower part 1*a* of the electrodeposition liquid bath 1', is located at a position A lower than the other end 4*b* of the tubular conduit 4. This arrangement is particularly preferable for a configuration that the electrodeposition liquid bath 1' has only one bath 1'A without the outer bath 1'B. Note that the electrodeposition liquid 2' quickly flows into the tubular conduit 4 to fill the tubular conduit 4.

As illustrated in FIG. 2, a plurality of the tubular conduits 4 may be desirably arranged in the electrodeposition liquid bath 1'. In FIG. 2, there are provided six of the tubular conduits 4 parallel to each other for the single electrodeposition liquid bath 1'. Each wire W moved through each of the tubular conduits 4 can be transferred at a speed common to the wires or at a specified speed for the wire according to the treatment condition of the wire W. Each of the wires W moved through the six tubular conduits 4 may have a diameter different from each other and a configuration different from each other to independently accomplish an desirable treatment thereof.

In the illustrated embodiment, there are provided a larger diameter main supporting shaft 10 and a smaller diameter secondary supporting shaft 11 opposed to the main supporting shaft 10 to hold the curbed portion 5 of the tubular conduit 4 there between. Plural pairs of the main supporting shaft 10 and secondary supporting shaft 11 may be arranged to support and turn the wire. The larger diameter main supporting shaft 10 is formed with a guiding channel 10*a* having a curbed surface R1 contacting an inner curbed surface 5*a* of the curbed portion 5. The smaller diameter secondary supporting shaft 11 has an outer peripheral curbed surface R2 to point-contact with an outer curbed surface 5*b* of the curbed portion 5. The main supporting shaft 10 and the secondary supporting shaft 11 each are defined in a generally circular cylinder or in a circular column. However, the main supporting shaft 10 and the secondary supporting shaft 11 each may be a square cylinder or a square column, which has an inner curbed surface R1 and an inner curbed surface R2 respectively at a corner thereof.

The main supporting shaft 10 has a diameter larger than the secondary supporting shaft 11, but the main supporting shaft 10 and the secondary supporting shaft 11 may have the same diameter. In the illustrated embodiment, there are arranged two pairs of the main supporting shafts 10 and the secondary supporting shafts 11 to hold the curbed portion 5 of the middle portion 4*c* of the tubular conduit 4, but another number of the main supporting shafts 10 and the secondary supporting shafts 11 may be provided.

Note that the wire is fed by a supply unit (not shown) and a winding unit (not shown) which are driven by a drive unit such as a motor like a known art. Alternatively, the apparatus has a motor-driven winding unit (not shown) for winding up the wire after the wire has passed the treatment liquid bath and has a wire feeding unit with an automatic tension device (not shown) for feeding the wire with a tension force exerted on the wire.

In thus configured embodiment of the present invention, the supply unit (not shown) feeds the wire W to provide an insulating film on an outer peripheral surface of the wire W. If required, the wire delivered from the supply unit is cleaned by a cleaning unit (not shown) to eliminate dust and contaminants thereon to prevent contaminants in the insulating film with a better adhesion property.

Next, the wire W is downward inserted into the tubular conduit 4. The tubular conduit 4 has the one end 4*a* connected to the lower part 1*a* of the electrodeposition liquid bath 1', the other end 4*b* opened upward, and the middle portion 4*c* with the curbed portions 5, 5. The tubular conduit 4 is filled with the electrodeposition liquid 2' which is contained in both the inner bath 1'A and the outer bath 1'B. The wire W receives a less friction force since the electrodeposition liquid 2' received in the tubular conduit 4 reduces a friction resistance of the wire W relative to the inner surface of the tubular conduit 4. Thus, a larger tensile force is not exerted on the wire W, so that the wire W is guided by the tubular conduit 4 to be adequately fed in the liquid bath 1 without disengagement from a predetermined path.

The tubular conduit 4 is defined in a U-shaped curve as illustrated in FIG. 1 so that the curbed portions 5, 5 each have a smooth curvature. Each curbed portion 5 has the inner curbed surface 5*a* supported by the guiding channel 10*a* formed in an outer peripheral surface of the larger diameter main supporting shaft 10. That is, the curbed portion 5 contacts the smooth curbed surface R1 of the guiding channel 10*a*. The curbed portion 5 has the outer curbed surface 5*b* which point-contacts the curbed surface R2 formed in an outer peripheral surface of the smaller diameter secondary supporting shaft 11. Thus, the tubular conduit 4 is supported by plural pairs of the main supporting shafts 10 and the secondary supporting shafts 11 therebetween. The tubular conduit 4 can keep smooth curvatures without an undue deformation. Thus, the wire W, which is moved from the top of the outer bath 1'B in FIG. 1, is fed through the tubular conduit 4 having the middle portion 4*c* formed with the smooth curbed portions 5, 5. The wire W downwardly received in the tubular conduit 4 turns upward to be smoothly fed into the inner bath 1'A without an excessive tensile force exerted on the wire. The wire W suffers neither damage nor breaking, allowing a constant continues transfer thereof.

In the embodiment, the main supporting shaft 10 has a larger diameter and the secondary supporting shaft 11 has a smaller diameter. However, the main supporting shaft 10 has the same diameter as the secondary supporting shaft 11. In FIG. 1, there are provided two pairs of the main supporting shafts 10 and the secondary supporting shafts 11 for supporting the curbed portion 5, 5 of the middle portion 4*c* of the tubular conduit 4. However, another number of the main supporting shafts 10 and the secondary supporting shafts 11 may be provided if desired.

The wire W will get a looseness remarkably less than the aforementioned conventional arts when the wire feeding is re-started after a pause thereof, allowing the wire W to be transferred again without a delay with an appropriate tensile force exerted thereon.

Thus, the wire W is provided with an insulating film on the outer periphery of the wire W as the wire W passes through the inner bath 1'A and the outer bath 1'B. Thereafter, the wire W is wound up on the bobbin of the winding unit (not shown) to complete the treatment of the wire W.

In the embodiment, as described above, the wire W is provided with an insulating film on the outer periphery thereof as the wire W passes through the inner bath 1'A and the outer bath 1'B, and the orientation of the wire W is turned in the outer bath 1'B. Alternatively, there may be provided only an inner bath 1'A (not shown) without the outer bath 1'B, and the other end 4*b* of the tubular conduit 4 is located at a position A higher than the one end 4*a* of the tubular conduit 4. In that configuration, the electrodeposition liquid 2' is quickly introduced into the tubular conduit 4 by a siphon effect so that the lubricity of the electrodeposition liquid 2' enables a less friction force exerted on the wire W, which is turned in the tubular conduit 4 when moved forward through the tubular conduit 4.

In the embodiment, the wire W is provided with an insulating film on the outer periphery thereof by depositing the electrodeposition liquid 2' contained in the electrodeposition liquid bath 1' on the wire W. However, the present invention can be applied, e.g., when the wire W is cleaned by a cleaning water contained in the treatment liquid bath 1, and when the wire W is galvanized at the outer periphery thereof by a galvanizing liquid contained in the treatment liquid bath 1.

What is claimed is:

1. An apparatus for feeding a wire such as an electrical conductor in a treatment liquid comprising:

a liquid bath containing the treatment liquid and a wire guiding means disposed in the bath for turning the direction of the wire to feed the wire into and out of the bath, wherein the wire guiding means includes a tubular conduit having a first open end disposed in the liquid, a second open end disposed above the liquid, and a middle curved portion for guiding the wire through the tubular conduit that is at least partially filled with the liquid.

2. The apparatus as claimed in claim 1 wherein the treatment liquid is an electrodeposition liquid and the treatment liquid bath contains the electrodeposition liquid.

3. The apparatus as claimed in claim 1 wherein a plurality of the tubular conduits are disposed in the treatment liquid bath substantially parallel with each other.

4. The apparatus as claimed in claim 1 wherein the tubular conduit is made from a prefabricated tube, and the first open end is connected to a bottom portion of the treatment liquid bath through a coupling such that the treatment liquid in the treatment liquid bath can flow into the tubular conduit, while the second open end is fitted on a support member.

5. The apparatus as claimed in claim 4 wherein the second open end is positioned higher than the first open end.

6. The apparatus as claimed in claim 1 further comprising a main supporting shaft and a secondary supporting shaft positioned opposed to the main supporting shaft, the main supporting shaft having a channel defined on an outer peripheral surface of the main supporting shaft for receiving and contacting an inner curvature surface of the curved portion of the tubular conduit, the secondary supporting shaft having an outer peripheral surface for contacting an outer curvature surface of the curved portion, whereby the curbed portion of the tubular conduit is supported by the main supporting shaft and the secondary supporting shaft therebetween.

7. The apparatus as claimed in claim 1 wherein the treatment liquid is a cleaning water and the treatment liquid bath contains the cleaning water.

8. The apparatus as claimed in claim 1 wherein the treatment liquid is a galvanizing liquid and the treatment liquid bath contains the galvanizing liquid.

9. The apparatus as claimed in claim 1 further comprising a motor-driven winding unit for winding up the wire after the wire has passed the treatment liquid bath.

10. The apparatus as claimed in claim 9 further comprising a wire feeding unit having automatic tension device for feeding the wire with a tension force exerted on the wire.

11. The apparatus as claimed in claim 1 wherein the tubular conduit is made of a synthetic resin material.

12. The apparatus as claimed in claim 1 wherein the tubular conduit is made of a polyurethane resin material.

13. The apparatus as claimed in claim 1 wherein the tubular conduit is made of a metal.

14. The apparatus as claimed in claim 1 wherein the tubular conduit is made of a stainless steel.

15. The apparatus as claimed in claim 1 wherein the tubular conduit is made of a copper alloy.

16. A method for feeding a wire such an electrical conductor in a treatment liquid contained in a liquid bath comprising that the wire is fed through a tubular conduit having a first open end disposed in the liquid, a second open end disposed above the treatment liquid, and a middle curved portion for guiding the wire through the tubular conduit.

17. The method as claimed in claim 16 wherein the treatment liquid is an electrodeposition liquid and the treatment liquid bath contains the electrodeposition liquid.

18. An apparatus for feeding a wire such as an electrical conductor in treatment liquid comprising:

a first bath containing a first treatment liquid, a second bath containing a second treatment liquid, and a wire guiding means disposed in the first bath for turning the direction of the wire in the first bath to feed the wire into and out of the first bath, wherein the wire guiding means includes a tubular conduit having a first open end disposed in the first liquid, a second open end connected to the second bath, and a middle curved portion for guiding the wire through the tubular conduit that is filled with the first liquid.

19. The apparatus as claimed in claim 18 wherein the first treatment liquid is the same as the second treatment liquid in treatment properties.

20. The apparatus as claimed in claim 18 wherein the first treatment liquid is different from the second treatment liquid in treatment properties.

* * * * *